United States Patent [19]

Nottingham

[11] 4,297,056

[45] Oct. 27, 1981

[54] METHOD AND H-PILE TIP FOR DRIVING PILES IN PERMAFROST

[76] Inventor: Dennis Nottingham, 2610 Sorbus Cir., Anchorage, Ak. 99504

[21] Appl. No.: 63,381

[22] Filed: Aug. 3, 1979

[51] Int. Cl.[3] ..... E02D 5/74

[52] U.S. Cl. ..... 405/232; 405/253

[58] Field of Search ..... 405/234, 130, 253, 254, 405/232

[56] References Cited

U.S. PATENT DOCUMENTS

| | | | |
|---|---|---|---|
| 3,123,978 | 3/1964 | Pruyn | 405/254 |
| 3,609,980 | 10/1971 | Bowers | 405/232 |
| 3,822,557 | 7/1974 | Frederick | 405/253 X |
| 3,921,410 | 11/1975 | Philo | 405/232 |
| 4,121,427 | 10/1978 | Tuttle | 405/234 X |
| 4,147,457 | 4/1979 | Washida | 405/232 |

FOREIGN PATENT DOCUMENTS

| | | | |
|---|---|---|---|
| 1118704 | 11/1961 | Fed. Rep. of Germany | 405/253 |

*Primary Examiner*—Dennis L. Taylor

[57] ABSTRACT

A method for facilitating the driving of piles in permafrost featuring the use of water filled pilot holes for raising the thermal regime of the surrounding permafrost to reduce the driving resistance of the permafrost and an improved H-pile shape with a tip having a reduced flange thickness to width ratio that is advantageously utilized in connection with such method.

5 Claims, 6 Drawing Figures

METHOD AND H-PILE TIP FOR DRIVING PILES IN PERMAFROST

PRIOR ART

Increasing development in the Arctic and Sub-Arctic has emphasized the need for suitably designed foundation structures capable of supporting buildings and other improvements in areas where permafrost exists. Many typical land forms in the Arctic and Sub-Arctic have resulted from glacial and periglacial action as well as other disposition processes. Soils profiles range from many discreet areas of interbedded gravels, sands and/or silts to completely heterogenous masses of glacial till and bedrock in various states. Permafrost may be present in all, part or none of such profiles. Further, profiles of permafrost range from warm, marginal permafrost, i.e. permafrost very near to experiencing a phase change to a water and soil slurry or thawed soil having a temperature of about 32° F., to cold dense permafrost, i.e. solidly frozen, nearly impenetrable permafrost having a temperature below 32° F.

For modern structures in permafrost regions, slab-on-grade or spread-footing foundation systems are often unsatisfactory because the post-construction thermal regime of the ground is difficult to control and the potential for differential thaw settlement is difficult to compensate for. As a result, pile foundations are frequently used to provide support for structures in known permafrost areas in the Arctic and Sub-Arctic. The primary reason for utilizing pile foundation systems in such areas is to maintain the permafrost in a stable frozen state over the useful life of the structure.

Frequently, such structures are supported entirely by a grid matrix of piles extending into the permafrost, with an open breeze-way left between the bottom of the structure and the surface of the ground. The heat removed by convective air currents flowing through the breeze-way during the winter months when the average ambient air temperature is below freezing usually exceeds or balances the corresponding heat gain occurring during the summer months when the average ambient air temperature is above freezing. As a result, the average yearly ground sub-surface temperature does not exceed 32° F., thereby maintaining the permafrost in a stable frozen state.

Another technique for maintaining the stability of the permafrost is to utilize refrigerated piling, particularly in warm, marginal permafrost. A variety of active and passive refrigeration methods are utilized in refrigerated pile systems. Active refrigerated piles remove heat from the ground through energized mechanical refrigeration principles, and passive refrigerated piles remove heat from the ground through unenergized phase change and convective gas or fluid flow principles.

Pile foundations in permafrost regions are generally constructed using one of three different methods: (1) the freeze-back method, (2) the driven method and (3) the back-fill method. Freeze-back piles are placed in permafrost by augering holes slightly larger than the diameter of the piles, placing the piles in the holes and back filling each hole with a water-soil slurry. The slurry is then allowed to freeze-back naturally or with the aid of artificial refrigeration. Driven piles are placed in permafrost with the aid of conventional mechanical hammers, both with and without the assistance of pre-drilled pilot holes. Back-filled piles are placed in permafrost by excavating sufficiently deep holes of relatively larger diameter than the piles, placing the piles where desired in the holes and back filling the holes about the piles with non-frost-susceptible material.

Of the three basic methods for placing piles, the back-fill method is the least desirable, because excavating and back filling the relatively large holes required for this method of placing piles is expensive, difficult and time consuming. Not infrequently, the nearest suitable source of non-frost-susceptible back-fill material is also located an appreciable distance from the building site and must be hauled in at considerable expense. The back-fill method is further complicated by the necessity for keeping the hole relatively dry to prevent it from caving in. If a water saturated talik (an unfrozen layer of soil found within or above a permafrost table) or a perched water table is present, the hole may not stand open without casing due to its relatively large size.

The freeze-back method of placing piles, while used on a wide spread basis, is frequently undesirable for many of the same reasons as the back-fill method. In addition, a lag time exists for the slurry about the pile to freeze to its full load bearing capacity. As a result, piles placed by the freeze-back pile method are often not usable for a significant period of time, delaying construction in areas where the building season is already frightenly short. Yet another problem is that a relatively large amount of water must be introduced into the pile holes to effect the freeze-back of the piles. This water may disturb the existing thermal regime in areas of warm, marginal permafrost to the extent that the heat introduced in the freeze-back slurry may preclude a natural freeze-back. In such a situation, expensive artificial refrigeration may be required to produce the required freeze-back, or the permafrost may deteriorate to the point where the use of the freeze-back method is precluded altogether.

The driven pile method is becoming increasingly the preferred method for placing piles in permafrost for a number of reasons. The advantages of driven piles—typically H-piles—are that the piles (1) can be subjected to immediate loading, (2) only minimally disturb the existing thermal regime of the surrounding ground, and (3) can be relatively rapidly, cheaply and easily aligned and placed under unfavorable weather conditions. An additional advantage is that the placement of a driven pile usually requires the employment of only one labor trade, as opposed to the multiple trades usually required to place piles using the freeze-back and back-fill methods. The potential for jurisdictional labor disputes in the union dominated construction business is, thereby, markedly reduced.

The main disadvantage of the driven pile method is the difficulty of driving the piles in cold dense, permafrost. Driving standard H-piles in cold dense permafrost has generally been successful only when favorable conditions are present. Experience has indicated that when sustained driving resistances exceed approximately 100 blows per foot, the structural soundness of standard H-piles may be impaired, resulting in buckling, twisting or excessive deformation of the piles.

To solve this problem, special H-piles for use in cold dense permafrost regions have been developed. Such special H-piles are not commonly available and not documented in the well known American Institute of Steel Construction (AISC) manual. Such piles principally differ from standard H-piles in that they have thicker, narrower flanges. Special H-piles are defined as those H-piles having a flange width to thickness ratio (b/t) of less than 17 and/or a flange width to web width ratio (b/d) of less than 1. A typical example of such a special H-pile is shown more particularly in FIG. 1.

The webs 9 of these special H-piles have been some times advantageously reinforced and stiffened by welding stiffeners 5 and 5', which may be constructed of angle iron, half round pipe or rectangular channels, along the longitudinal axis of the web. At the driving end of these special H-piles, stiffeners 5 and 5' have been usually fabricated into a pointed tip 7 to assist the driving of the pile, as is shown in FIG. 2. With this support and tip configuration, pile misalignment and buckling, i.e. deformation of flange 3 or web 9 of the special H-pile, in the direction of the principal compressive stress, is considerably reduced.

Small diameter pilot holes are occasionally advantageously drilled just short of the design tip elevation of the piles. If the cross-sectional area of a pilot hole is roughly equal to the cross-sectional driving area of the pile, much of the driving resistance stress is relieved by the pilot hole. The pilot hole also serves to guide the pile and maintain a pre-determined alignment for the pile. Since the cross-sectional area of such a pilot hole is significantly less than that of a hole typically required to place a pile using the freeze-back method and considerably less than that required to place a pile using the back-fill method, it is usually not difficult to drill a pilot hole in conditions where a water saturated talik or a perched water table is encountered. Further, such pilot holes need not remain completely open during the driving process to be effective.

Unfortunately, even if pilot holes are utilized, in most cases it remains impossible to drive standard H-piles—which are far cheaper and easier to obtain than special H-piles—in cold dense permafrost without experiencing local buckling, tip deformation and misalignment of the piles. As a result of these and other related problems, new and improved pile driving methods and reinforced pile tips are required for placing piles in cold dense permafrost.

SUMMARY OF THE INVENTION

The invention lies in a method for driving piles into cold dense permafrost that includes the steps of (a) drilling a pilot hole having a cross-sectional area comparable to the cross-sectional driving area of the pile along the desired pile alignment, (b) filling the pilot hole with water a predetermined time before driving the pile, and (c) driving the pile through the water-filled pilot hole to its design tip elevation. A sufficient amount of heat is transferred from the water to the surrounding permafrost in the immediate area of the pilot hole without significantly melting the permafrost to greatly facilitate pile driving process. Due to the relative equality of the cross-sectional area of the pilot hole and the driving area of the pile, the surface area of the pile forms an adfreeze friction bond primarily with the permafrost itself, rather than merely frozen water as in the case of a freeze-back pile, thereby (a) creating a stronger adfreeze friction bond between the pile and the permafrost and (b) allowing the design load bearing capacity of the pile to be relatively rapidly achieved. The invention also lies in utilizing a new driving tip for a standard H-pile—as opposed to a special H-pile—suitable for driving in cold dense permafrost utilizing this pile driving method. The tip is comprised of an "H" shaped section that (a) features a significantly reduced flange width to thickness (b/t) ratio with respect to a standard H-pile, (b) is of otherwise relatively the same dimensions as the H-pile, (c) is welded or otherwise fixedly attached to the driving tip of the pile.

DETAILED DESCRIPTION OF THE INVENTION

Figure 4:
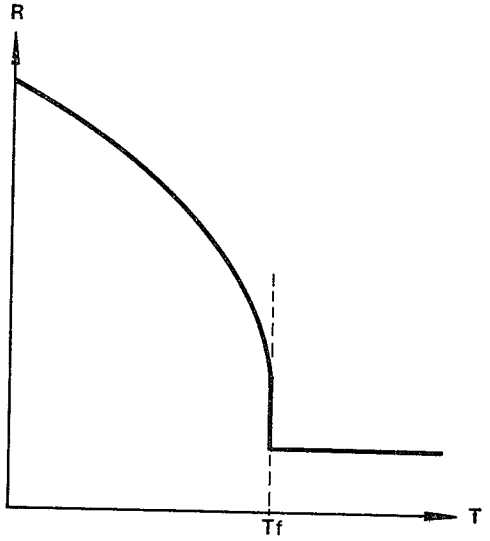
FIG. 4 depicts a graph demonstrating the empirical relationship between the typical resistance of cold dense permafrost to pile driving as a function of the permafrost temperature.

Referring to FIG. 4, it has been empirically discovered that the relationship between the resistance of cold dense permafrost to pile driving and the temperature of the permafrost generally follows the mathematical relationship: $R=f(T,m)$, where (1) R represents the pile driving resistance measured in units of energy, (2) T represents the permafrost temperature in corresponding units, (3) m represents a constant or variable that is a function of the peculiar properties of the given permafrost, and (4) $T_f$ represents the freezing point of water. Most importantly, the relationships depicted in FIG. 4 illustrate that the resistance of cold dense permafrost to pile driving decreases as a function of the temperature of the permafrost increases until the freezing point of water is reached.

Figure 5:
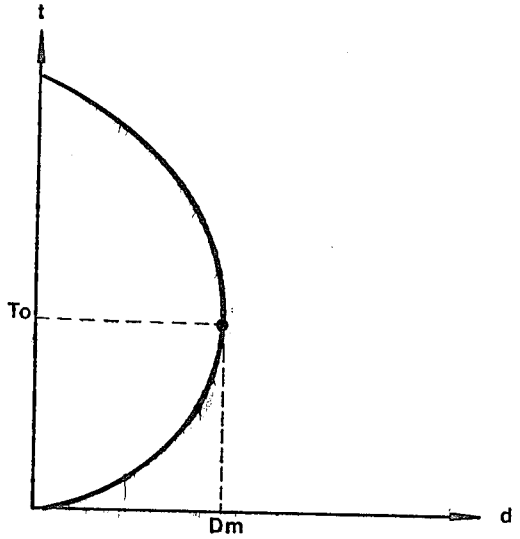
FIG. 5 illustrates the empirical relationship between the distance from the center of a water filled pilot hole in cold dense permafrost that the permafrost is raised to a constant temperature as a function of time.

It has also been empirically discovered that, when a pilot hole in cold dense permafrost is filled with water, the relationshp between the elapsed time after the hole is filled with water and the distance from the longitudinal axis of the pilot hole at which the temperature of the permafrost has been raised to some constant temperature T by the water is generally as depicted in FIG. 5. As time passes, the distance at which the temperature of the surrounding permafrost is raised to the temperature T first increases as heat is transferred from the water to the surrounding permafrost and thereafter begins to decrease as the water begins to cool off. As will be observed, the relationship between the elapsed time t and the distance d generally follows a non-linear curve, reaching a maximum distance $D_m$ and then decreasing to zero along the horizontal axis with the further passage of time. Using this relationship, it is possible to choose an optimum time $T_o$ after a pilot hole of a predetermined diameter is drilled for the purpose of achieving minimum soil resistance to pile driving.

The invention primarily lies in the utilization of the empirical principles and relationships taught in FIGS. 4 and 5 in a new and improved method for driving piles in cold dense permafrost. This method begins with drilling a pilot hole—usually just short of the design elevation tip of the pile—along the desired pile alignment. The cross-sectional area of the pilot hole is advantageously chosen to be comparable to the cross-sectional driving area of the pile. When a pile is driven down along the alignment of the pilot hole, the soil displaced by the pile is relatively of the same volume as the pilot hole, thereby avoiding significant displacement of the immediately neighboring permafrost and undesirable voids. A suitable time prior to the driving of the pile, dependent upon (a) the peculiar properties of the local permafrost, (b) the temperature of the water, (c) the cross-sectional area of the pilot hole, and (d) the driving area of the pile, the pilot hole is filled with water. The pile is then driven after an elapsed time calculated (a) to maximize the distance from the longitudinal axis of the pilot hole at which the temperature of the immediately surrounding permafrost is sufficiently raised by the water and (b) to minimize the soil's resistance to the pile driving given the peculiar properties of the subject permafrost and dimensions of the subject pile.

If such properties and dimensions are properly coordinated, the temperature of the permafrost in the immediate cross-sectional area of the pile is increased to a point—usually the freezing temperature of water—which greatly facilitates the driving of the pile without actually causing the permafrost to undergo a phase change to a slurry of water and soil or thawed soil. This critical temperature is relatively easy to achieve, because it requires 79 calories of energy per gram of ice to cause the ice to undergo a phase change to water and only 1 calorie of energy per gram of ice to raise the temperature of the ice 1°. As a result, a comfortable margin of error exists for raising the temperature of the surrounding permafrost to the melting point of water without significantly melting the permafrost through the introduction of water in the pilot hole for the purposes of facilitating the pile driving.

Figure 6:
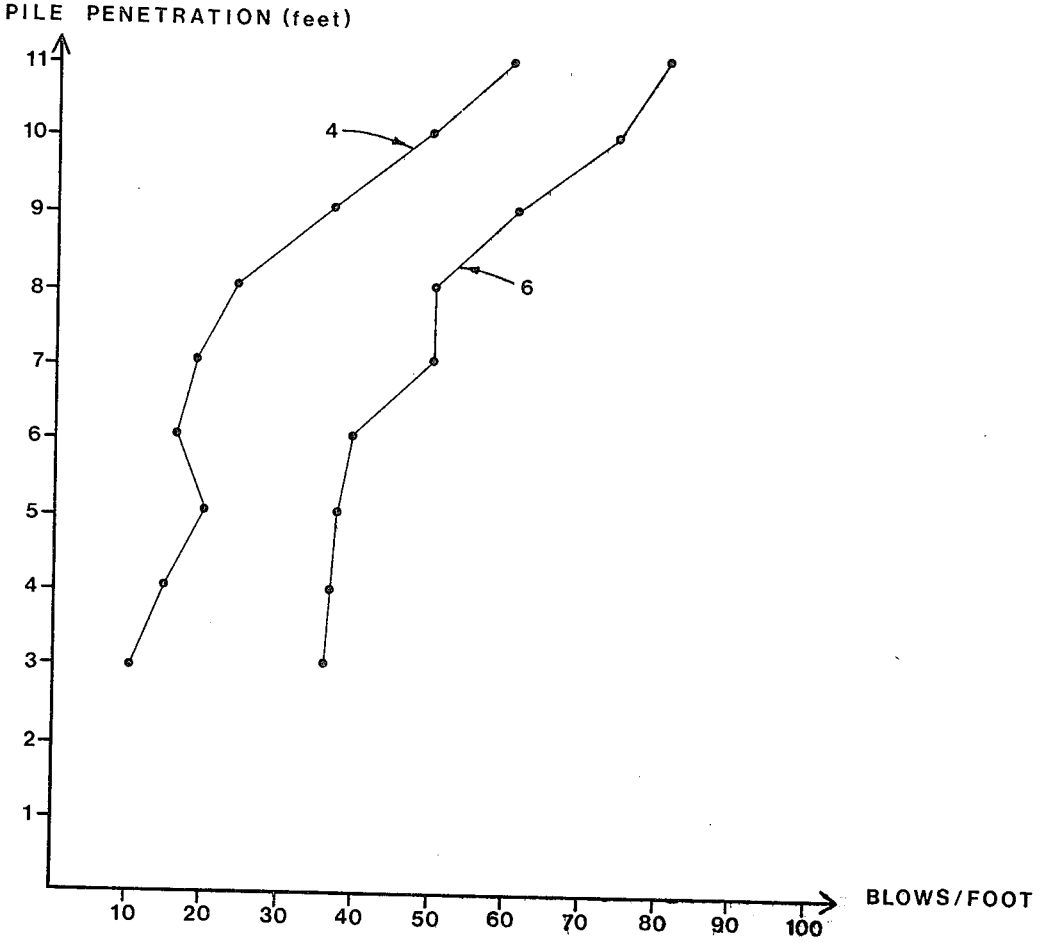
FIG. 6 illustrated the comparative amounts of energy required to drive reinforced tip, standard H-pile with water-filled pilot holes and dry pilot holes in cold, dense permafrost.

FIG. 6 illustrates the resultant advantages of this method of driving piles in cold dense permafrost. A standard test H-pile 6 (HP 10×57 with welded Ls3×3×3/8 H-pile reinforced tip) was mechanically driven in cold dense permafrost near Dead Horse, Alaska, in April, 1979, for a period of 20 minutes in a dry pilot hole having a cross-sectional area that was comparable to the driving area of test pile 6. The relationship between the depth of the test pile's penetration and the energy imparted by the Delmag D-15 mechanical hammer used to drive test pile 6 is depicted in FIG. 6. At or about the same time, an identical test pile 4 was driven in a corresponding pilot hole that has been filled with water having an initial temperature of approximately 120° F. approximately 1 hour before test pile 4 was driven using the same hammer. Only 10 minutes of driving time was required to achieve the same tip elevation for test pile 4 that was achieved for test pile 6. The relationship between the tip elevation and energy imparted to reach that elevation for the two respective test piles are illustrated more particularly in FIG. 6.

Figure 1:
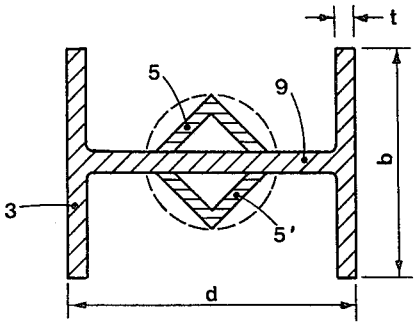
FIG. 1 depicts a cross-sectional view of a reinforced web, H-pile having a flange width to thickness ratio of b/t and a flange width to web width ratio of b/d.
Figure 2:
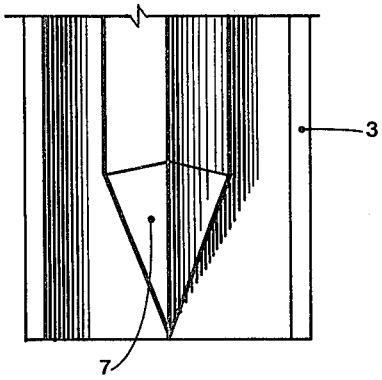
FIG. 2 illustrates an advantageous pointed tip at the lower end of the stiffener member of a web reinforced H-pile that facilitates the driving of the pile.
Figure 3:
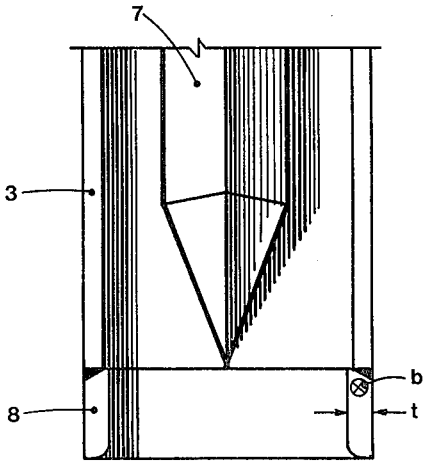
FIG. 3 shows a reinforced H-pile section driving tip having a relatively small flange width to thickness ratio b/t which is welded to a standard H-pile.

Pile driving using this method may be advantageously facilitated through the use of a tip comprised of a special H-shaped section having generally the same dimensions as a standard H-pile section, but featuring a significantly reduced flange width to thickness ratio (b/t). A side view of such a special tip welded to a standard H-pile is shown more particularly in FIG. 3. This special tip advantageously enables a standard H-pile to be driven in cold dense permafrost; because it has been discovered that most buckling, twisting and deformation suffered in a standard H-pile driven in cold dense permafrost occurs primarily in the tip region. It has also been discovered that this buckling, twisting and deformation is usually inversely proportional to the flange width to thickness ratio of the pile tip.

These problems are solved by welding a special H-shaped tip section to a standard H-pile which has a relatively large flange width to thickness ratio (b/t) with respect to that of the tip section. The effect of the composite pile section is that the special H-pile section tip prevents the excessive buckling, twisting and deformation that would otherwise occur if the standard H-pile alone were driven in cold dense permafrost, thereby eliminating the need for an entire, more expensive and difficult to obtain special H-pile.

An important feature of this new tip section lies in the continuous web reinforcement mechanism which runs along the length of the web section of the standard H-pile attached to the tip. In the past, the reinforcement mechanism was of lesser importance because the entire length of the special piles required for pile driving in cold dense permafrost were of equal strength and, therefore, offered equal resistance against buckling, twisting and deformation under conditions of excessive driving resistance. Now that the new tip section allows the driving of cheaper and far more available standard H-piles in cold dense permafrost, the reinforcing mechanism takes on added importance, because it is usually indispensable to prevent the standard H-pile portion of the resulting composite pile from buckling under conditions of excessive driving resistance. More particularly, it enables a vertical load that would otherwise deform a standard H-pile to be transmitted to the new, relatively low flange-width-to thickness ratio tip without buckling the resulting pile.

The foregoing embodiments of the invention taught herein are intended to be illustrative only of the invention and are not exhaustive of the multiple and varied embodiments that fall within the spirit and scope of the invention. All such other embodiments of the invention are also intended to be covered by this patent as if fully described and illustrated particularly herein.

I claim:

1. A method for driving piles in frozen soil comprising the following steps:
   a. drilling a pilot hole along the desired pile alignment;
   b. inserting water into the pilot hole at a temperature suitably above the freezing point of water; and
   c. driving the pile through said pilot hole a predetermined period of time thereafter calculated to permit the transfer of a sufficient amount of heat from the water to the frozen soil surrounding said pilot hole to reduce the resistance of the frozen soil to the driving of said pile.

2. The method in accordance with claim 1 in which
   a. said period of time is calculated to minimize said driving resistance; and
   b. said pilot hole has a cross-sectional area corresponding approximately to the driving area of said pile.

3. The method in accordance with claim 1 in which
   a. no significant portion of said frozen soil surrounding said pilot hole is allowed to significantly melt; and b. said frozen soil subsequently forms an adfreeze friction bond with the surface area of said pile adjacent thereto.

4. The method in accordance with claim 1 in which a. said pile is an H-pile; and b. said H-pile has an H shaped tip section of relatively the same dimensions as said pile, but featuring a significantly reduced flange width to thickness ratio with respect to that of said H-pile.

5. The method in accordance with claim 1 in which the temperature of said water, and the length of said period of time are coordinated with the temperature of said frozen soil, the depth and cross sectional area of said pilot hole and the properties of said frozen soil a. to prevent said water from freezing prior to the completion of the driving of said pile; and b. to transfer sufficient heat to said frozen soil to reduce the driving resistance of said pile without significantly melting said frozen soil.

* * * * *